US007123860B1

(12) United States Patent
Zona

(10) Patent No.: US 7,123,860 B1
(45) Date of Patent: Oct. 17, 2006

(54) SMALL FOOTPRINT CHARGE DEVICE FOR TANDEM COLOR MARKING ENGINES

(75) Inventor: Michael Zona, Holley, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 11/115,151

(22) Filed: Apr. 27, 2005

(51) Int. Cl.
*G03G 15/02* (2006.01)

(52) U.S. Cl. ..... 399/171; 399/115

(58) Field of Classification Search ..... 399/171, 399/115

See application file for complete search history.

(56) References Cited

U.S. PATENT DOCUMENTS 2,777,957 A * 1/1957 Walkup ..... 250/325
4,728,983 A 3/1988 Zwadlo et al.
5,206,784 A * 4/1993 Kimiwada et al. ..... 361/229
5,655,186 A * 8/1997 Godlove et al. ..... 399/171
5,845,179 A 12/1998 Damji et al.
5,909,608 A * 6/1999 Manno et al. ..... 399/173
6,459,873 B1 10/2002 Song et al.
6,553,198 B1 * 4/2003 Slattery et al. ..... 399/171

FOREIGN PATENT DOCUMENTS

JP 58140758 A * 8/1983
JP 58200254 A * 11/1983
JP 62269176 A * 11/1987

OTHER PUBLICATIONS

U.S. Appl. No. 10/891,319, filed Jul. 14, 2004, Zona et al.

* cited by examiner

*Primary Examiner*—David M. Gray
*Assistant Examiner*—Joseph S. Wong
(74) *Attorney, Agent, or Firm*—Oliff & Berridge, PLC

(57) ABSTRACT

In a xerographic printing apparatus, a small footprint charging device may provide uniformity of charge and/or long life in a small diameter photoconductive drum. A grid to be parallel to the drum surface and including small wing shields may reduce or even prevent leakage of corona current to the photoconductor around the grid region, which may otherwise detract from charge uniformity.

16 Claims, 3 Drawing Sheets

SMALL FOOTPRINT CHARGE DEVICE FOR TANDEM COLOR MARKING ENGINES

Cross-reference is made to co-pending, commonly assigned applications, including: U.S. patent application Ser. No. 10/891,319, filed Jul. 14, 2004, entitled "Xerographic Charging Device Having Two Pin Arrays," which is herein incorporated by reference.

BACKGROUND

The present disclosure relates to marking engines within electrostatographic printing or xerography systems. Specifically this disclosure relates to a charging device that may be used in a marking engine within a xerographic system.

In electrostatographic systems, a photoreceptor may be supported by a mechanical carrier such as a drum or a belt. The photoreceptor may be charged to a generally uniform charge by subjecting the photoreceptor to a suitable charging device. The charge distribution on the photoreceptor may then be altered by the application of radiation, e.g., a laser, to the surface of the photoreceptor. Toner particles may then be transferred, by the application of electric charge, to a print sheet, thus forming the desired image on the print sheet. The toner particles adhere electrostatically to the suitably charged portions of the photoreceptor. An electric charge may also be used to separate or "detack" the print sheet from the photoreceptor.

For the initial charging, transfer, or detack of an imaging surface, the most typical device for applying a predetermined charge to the imaging surface may be a "corotron," such as a scorotron or dicorotron. Common to most types of corotron may be a bare conductor, in proximity to the imaging surface, which may be electrically biased and thereby supplies ions for charging the imaging surface. The conductor typically comprises one or more wires (often called a "corona wire") and/or a metal bar forming saw-teeth (a "pin array"). The conductor may extend parallel to the imaging surface and along a direction perpendicular to a direction of motion of the imaging surface. Other structures, such as a grid, conductive shield and/or nonconductive housing, are typically present in a charging device, and some of these may be electrically biased as well. A corotron having a grid disposed between the conductor and the photoreceptor is typically known as a "scorotron."

U.S. Pat. No. 5,845,179, incorporated by reference in its entirety, discloses design rules for a corotron, with the objective of minimizing the production of ozone, which may detract from charge uniformity.

U.S. Pat. No. 6,459,873, incorporated by reference in its entirety, discloses a xerographic charging device apparatus having two independently controllable scorotrons.

Monochrome printers produce a hard copy in one toner color, typically black, and the copy may be made in a single pass of the charging device and toner source over the photoreceptor.

On the other hand, color printers may use three primary colors, typically cyan, magenta and yellow, and in addition, optionally black. Several techniques have been developed over the years to adapt xerographic techniques to use multiple colors.

An exemplary apparatus for making high quality color prints by xerographic systems is discussed in U.S. Pat. No. 4,728,983, incorporated by reference in its entirety. A single photoconductive drum may be electrostatically charged, laser-scan exposed, and toner developed during one rotation. In successive rotations, different colored images corresponding to color separation images may be assembled in registration on the drum. This assembled color image may be transferred to a receptor sheet in a final rotation of the drum.

Advancements in xerographic technology include tandem color marking engines, which comprise a plurality of charging devices. Such devices may be suitable for high-speed applications and have been developed for both photoconductive drums and belt systems.

SUMMARY

An area of ongoing research and development is in reducing the overall size of system components toward the goal of developing an economical and capacity-extendible all-in-one process cartridge. Such a cartridge may be easily adapted for use in a family of compact electro-statographic reproduction machines having different volume capacities and consumable life cycles. Furthermore, a smaller process cartridge may be advantageously used in parallel tandem color marking engines to increase machine throughput.

Current charge device technology does not provide both uniform charging and long life, simultaneously, for small photoconductor drums less than 60 mm in diameter. Corona generating devices may provide long drum life by not contacting the drum surface. However, such devices may only provide good uniformity against larger diameter drums. Low waterfront contact chargers may provide good uniformity on small diameter drums (less than 60 mm), but may result in short drum life due to photoreceptor transport layer wear.

Exemplary embodiments of a small footprint charging device may combine the benefits of a smaller drum size provided by contact chargers with the long drum life feature of a corona generator. Such exemplary embodiments may provide a small diameter photoconductor drum with both long life and uniformity of charging.

An exemplary embodiment of a charge device for applying a charge to a surface of a charge receptor may include at least one one-dimensional pin array and a grid spaced apart from the at least one pin array, the grid including a first side wing and a second side wing. The grid may be disposed between the at least one pin array and the surface of the photoconductor surface, and may be shaped as to be parallel to the photoconductor surface.

Reducing the width of the grid to reduce the footprint of the charge device may increase leakage of corona current to the photoconductor around the grid region, which may degrade charge uniformity. Small shield, or wing extensions disposed on the sides of the grid may reduce or even prevent corona leakage around the grid and may provide mechanical stiffness benefits.

Thus, exemplary embodiments of a grid with wing extensions may reduce the footprint of charge device, thereby reducing the space required for tandem color marking engines.

BRIEF DESCRIPTION OF THE DRAWINGS

Various exemplary embodiments are described in detail, with reference to the following figures, wherein:

FIG. 3 illustrates current profiles for a variety of exemplary grid designs.

DETAILED DESCRIPTION OF EMBODIMENTS

Figure 1:
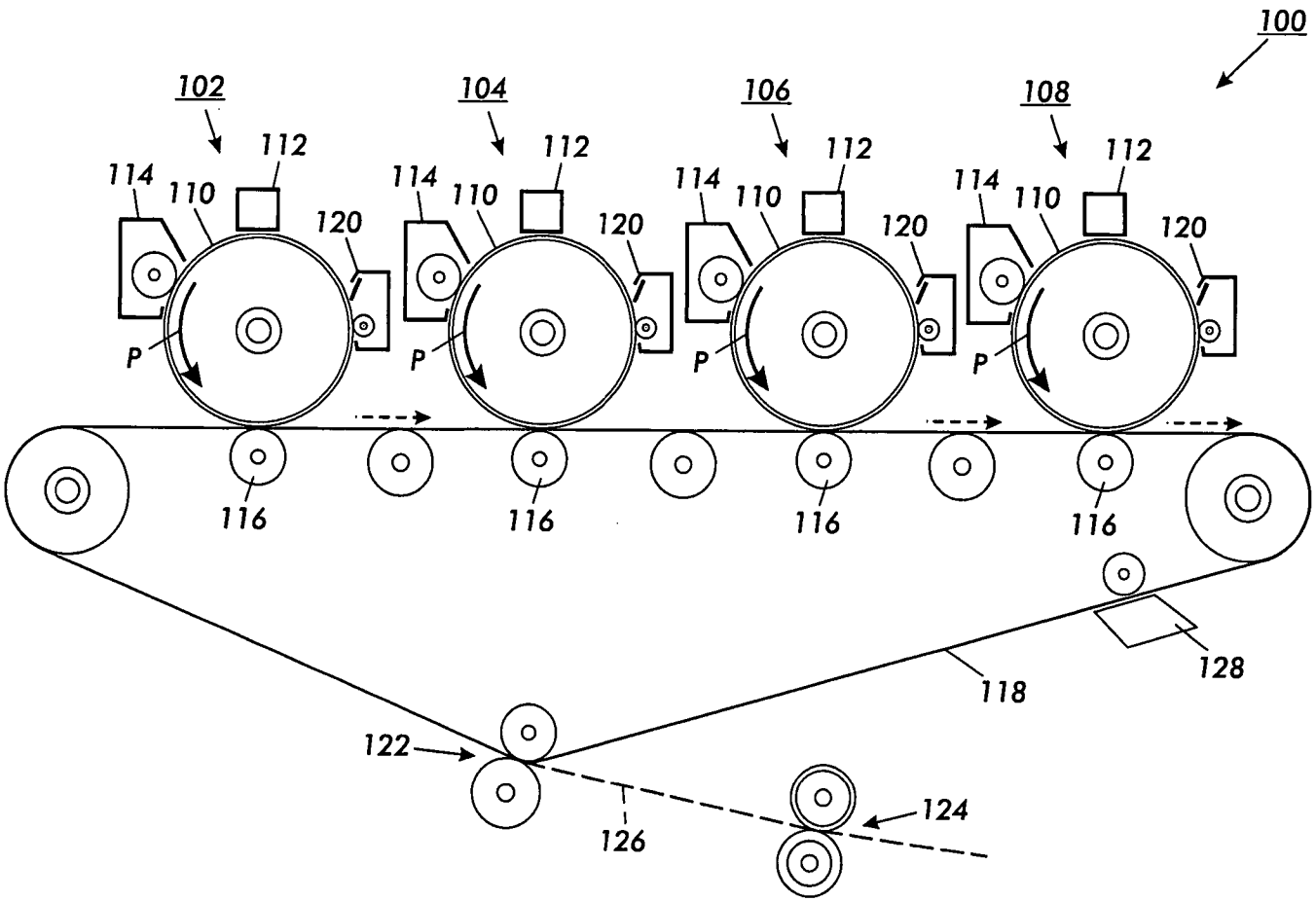
FIG. 1 is an elevational view showing elements of exemplary tandem color marking engine.

The following detailed description makes specific reference to xerographic devices, such as illustrated in FIG. 1, and is particularly directed to a small footprint scorotron charging device that provides for uniform charging and a longer lasting photoconductive medium. However, it should be understood that the principles and techniques described herein may be used in other devices and methods, for example, color as well as monochrome printers, photoreceptor drum as well as belt supported systems, raster output scanner (ROS) systems as well as electrostatographic devices utilizing direct writing techniques such as full width array (FWA) LED imaging. The embodiments described are illustrative and non-limiting.

FIG. 1 is an elevational view showing elements of an electrostatographic or xerographic color marking engine 100, such as a copier or a "laser printer." The marking engine 100 may include four tandem process cartridges 102–108, each providing one of three primary colors, typically cyan, magenta and yellow, and in addition, optionally black. Each process cartridge 102–108 may function similarly. As such, only the operation of a single process cartridge is discussed as representative of all four process cartridges.

Figure 2:
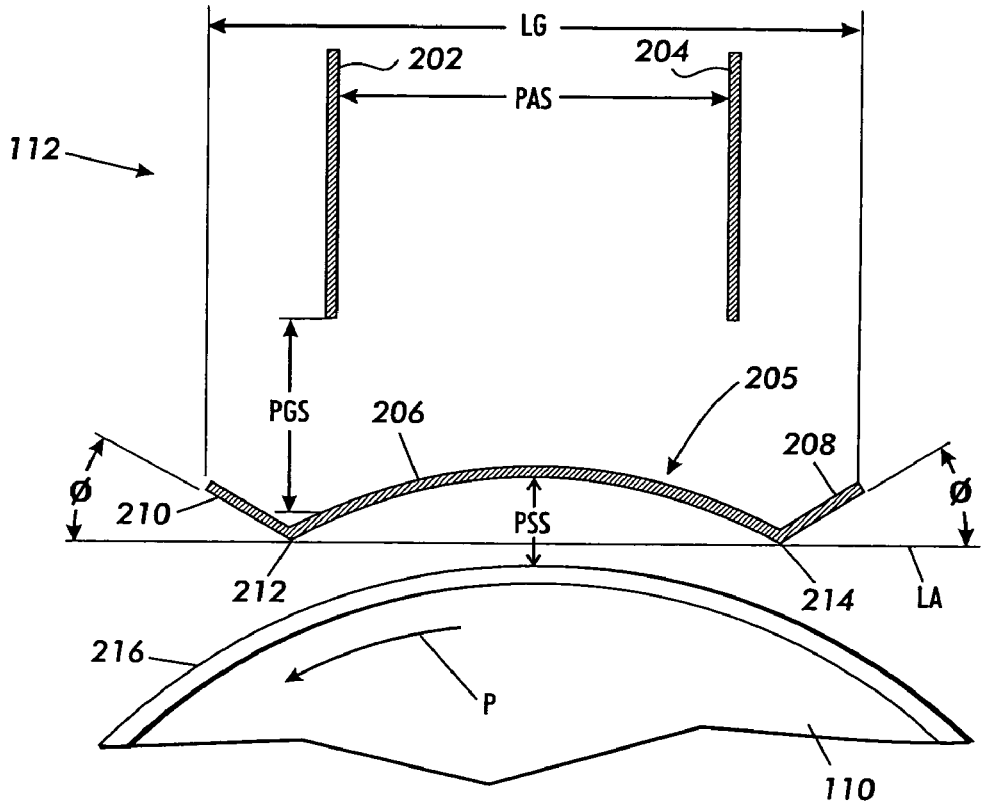
FIG. 2 is an elevational, sectional view of an exemplary two-array scorotron of the printer of FIG. 1.

Each process cartridge may comprise a charge receptor such as photoreceptor 110, which although shown in FIGS. 1 and 2 as a drum 110, may be in the form of a belt or other photoreceptive transfer medium. The photoreceptor may define a charge-retentive surface for forming electrostatic images thereon. The photoreceptor 110 may be rotated in a process direction P.

The first step in the process may be an initial charging of a relevant surface of the photoreceptor 110. This initial charging may be performed by a charge device 112 that imparts an electrostatic charge on the surface of the photoreceptor 110 rotating past the charge device 112. The charged portions of the photoreceptor 110 may then be selectively discharged in a configuration corresponding to a desired image to be printed, for example, by a raster output scanner (ROS), not shown, which generally comprises a laser source and a rotatable mirror which act together, in a manner known in the art, to discharge certain areas of the surface of photoreceptor 110 according to the desired image to be printed.

Although a laser may be used to selectively discharge the surface of the photoreceptor 110, other apparatus that may be used for this purpose may include an LED bar, or, in a copier, a light-lens system. The laser source may be modulated (turned on and off) in accordance with digital image data fed thereto, and the rotating mirror may cause the modulated beam from laser source to move in a fast-scan direction perpendicular to the process direction P of the photoreceptor 110.

After certain areas of the photoreceptor 110 are discharged, the remaining charged areas may be developed by a developer unit 114, for example, causing a supply of dry toner to contact or otherwise approach the surface of photoreceptor 110. The developed image may then be advanced, by the motion of photoreceptor 110, to a bias transfer roller, or transfer station 116, for example, causing the toner adhering to the photoreceptor 110 to be electrically transferred to a common intermediate transfer belt 118. Any residual toner remaining on the photoreceptor 110 may be removed by a cleaning blade 120 or equivalent device.

After each process cartridge 102–108 transfers its image to the belt 118, the complete color image may be transferred at transfer station 122 to a medium, such as a sheet of plain paper 126, to form the image thereon. Belt cleaner 128 may clean the transfer belt 118 of any residual toner. The sheet of plain paper 126, with the toner image thereon, may then be passed through a fuser 124, for example, causing the toner to melt, or fuse, into the sheet of paper 126.

Although the color process cartridges shown in FIG. 1 operate in a tandem color marking engine, corresponding elements may operate in other color marking engines including a single photoreceptor with multiple exposure and development devices, as well as in monochrome printers including a single photoreceptor and a single exposure and development device.

Furthermore, the photoreceptor 110 and charge device 112 may be configured as part of a cartridge that is readily removable and replaceable, relative to a larger printing apparatus. Such removable cartridges may further include a supply of marking material and/or a fusing mechanism.

FIG. 2 is an elevation view of an exemplary charging device 112. Although the charging device in FIG. 2 may be a scorotron comprising two pin arrays 202, 204 for redundancy, the number of pin arrays in the charging device 112 is non-limiting and may comprise a single pin array. The two pin arrays 202, 204 may be disposed parallel to and spaced from each other by an array spacing (PAS) of about 6 mm to about 10 mm. A curved portion 206, of a grid 205, may be spaced about 6.5 mm to about 9.5 mm (PGS) from the tip of pin arrays 202, 204, and may be disposed parallel to a curved surface 216 of a photoreceptor drum 110.

In exemplary embodiments, the curved grid portion 206 may have a 15.5 mm radius, and may be positioned a distance of about 1.0 mm to about 1.5 mm (PSS) from the surface of a 30 mm diameter photoreceptor drum 110. The curved grid portion 206 may be composed of steel and may define an array of openings, for example, in a roughly hexagonal-honeycomb pattern. The curved grid design may provide approximately twice the amount of current flow to a bare drum plate as compared to a flat grid design of similar dimensions. Although the exemplary embodiments described herein may be specifically adapted to a curved photoreceptor drum, the shape of the charging device is non-limiting and may be adapted to photoreceptors of other shapes, e.g. a flat, belt driven photoreceptor.

Extending from each opposing edge 212 and 214 of the curved grid portion 206 may be 2 to 5 mm long side shields or wings 208, 210. Side wings 208, 210 may extend at an angle $\phi$ from a line LA drawn between the edges 212, 214 of the curved portion 206 of the grid 205. Side wings 208, 210 may operate to reduce or even prevent leakage of corona current to the photoreceptor 110 around the grid 206, which may otherwise degrade charge uniformity. As shown in FIG. 2, angle $\phi$ may be in a range from about positive 30 degrees to about minus 30 degrees and a distance between the outer edges of wings 208, 210 may be approximately 14 to 18 mm (LG).

The range of angle $\phi$ may be determined so as to maximize charging uniformity, while minimizing the width LG of the charging device 112. Angles less than minus 30 degrees may increase the width LG of the device 112, which may lead to interference with other subsystems surrounding the photoreceptor 112. Angles larger than positive 30 degrees may lead to arcing between the tips of the pin arrays 202, 204 and the edge of the wings 208, 210.

Wings 208, 210 may be formed of a same material as the curved grid portion 206 and may have a same hexagonal-honeycomb pattern as the curved portion 206 of the grid 205. Alternatively, wings 208, 210 may be solid, for example, to provide additional mechanical support to the patterned curved portion 206 of the grid 205.

Figure 3:
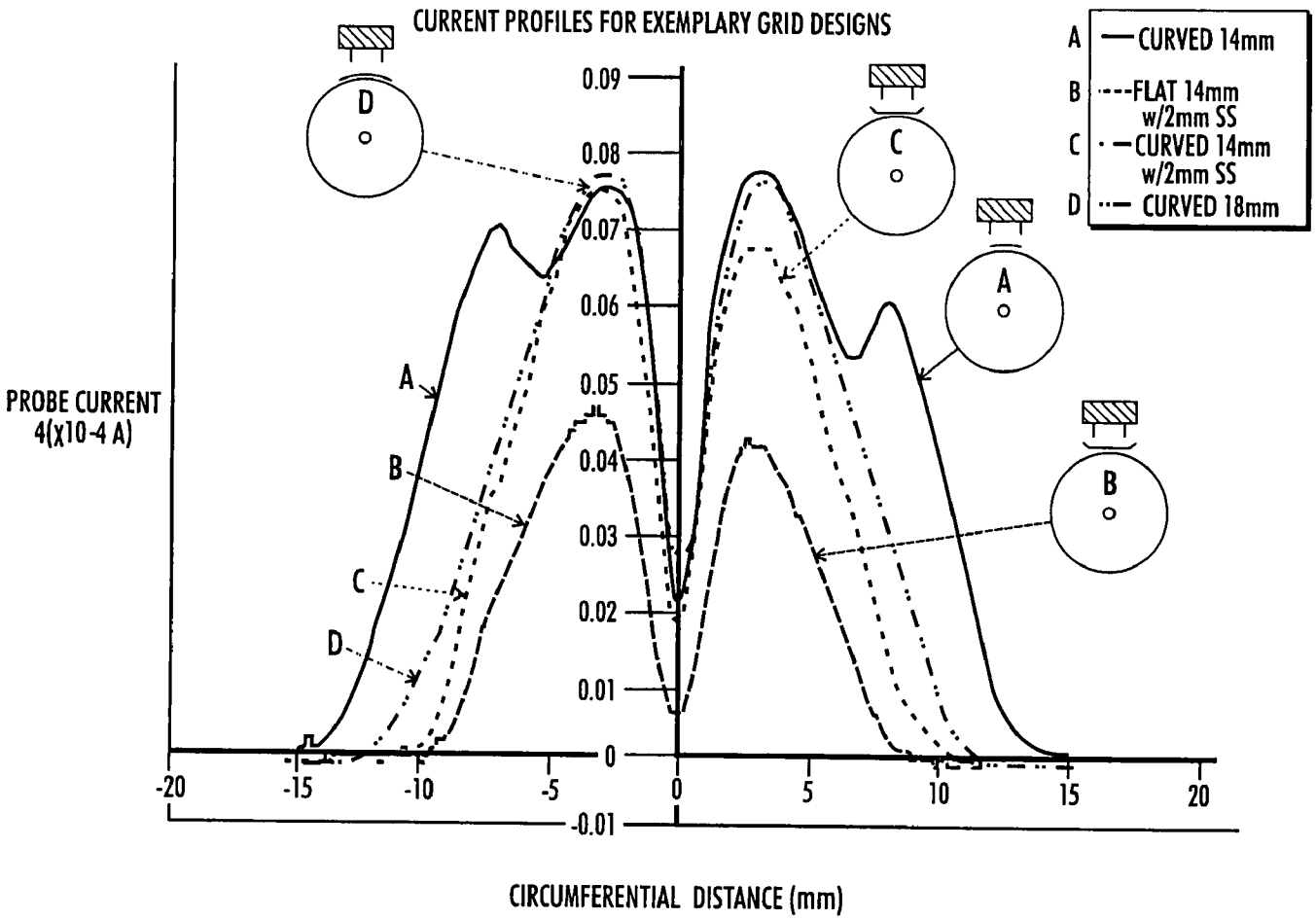
FIG. 3 is a perspective view of an exemplary grid used in the scorotron of FIG. 2.

The chart of FIG. 3 illustrates exemplary current profiles for exemplary grid designs for use with a 14 mm wide scorotron and a 40 mm diameter photoreceptor drum. The double peaks recorded for each profile indicate the location of the dual pin arrays 202, 204 and the notch at the zero circumferential distance indicates the midpoint between the two arrays 202 and 204.

Current profile A illustrates a current profile for a curved 14 mm grid without side wings. Current profile B illustrates a current profile for a flat 14 mm grid with side wings. Current profile C illustrates a current profile for a curved 14 mm grid with side wings. Current profile D illustrates a current profile for a curved 18 mm grid without side wings. As in profile C, the 2 mm side wings 208, 210 may reduce or even prevent flow of negative ions around the grid, thereby preventing non-uniform charging of the photoreceptor. Furthermore, the curved grid portion of profile C may operate to provide higher current concentration at the locations on the photoreceptor corresponding to the pin arrays 202, 204, as compared to the flat 14 mm grid with side wings, as indicated by profile B.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art and are also intended to be encompassed by the following claims.

What is claimed is:

1. A charge device for applying a charge to a surface of a charge receptor, the charge device comprising:

at least one one-dimensional pin array; and a curved grid spaced apart from the at least one pin array, the curved grid including a first side wing, a second side wing, a first edge from which the first side wing extends and a second edge from which the second side wing extends, the first side wing and the second side wings extending away from direction of concavity of the curved grid in a range from 0 to about 30 degrees from a line extending through the first and second edges.

2. The charge device according to claim 1, wherein the wings are about 2 to 5 mm long.

3. The charge device according to claim 1, further comprising a first one-dimensional pin array and a second one-dimensional pin array.

4. The charge device according to claim 1, wherein the wings are solid.

5. The charge device according to claim 1, wherein the wings and the grid comprise a unitary structure.

6. The charge device according to claim 1, further comprising a charge receptor, wherein the first side wing and the second side wing extend away from the surface of the charge receptor at an angle in a range of 0 to about 30 degrees relative to a line drawn between a first junction of the grid and the first side wing and a second junction of the grid and the second side wing.

7. The charge device according to claim 1, further comprising a charge receptor including a curved surface, wherein the curved grid is spaced apart from and parallel to the curved surface of the charge receptor by a predetermined distance.

8. The charge device according to claim 7, wherein the curved grid is spaced about 1.0 mm to about 1.5 mm apart from the charge receptor.

9. A xerographic device comprising the charge device of claim 1.

10. An electrostatic printing apparatus, comprising:

a charge receptor including a surface;

a charge device configured to apply a charge to the surface of the charge receptor, the charge device comprising:

a first one-dimensional pin array, a second one-dimensional pin array, the first pin array spaced from the second pin array by an array spacing; and a grid including a portion parallel to the charge receptor, wherein the grid is disposed between the pin arrays and the surface of the charge receptor, the grid spaced from the first pin array, the grid including a first side wing and a second side wing extended from opposing edges of the portion of the grid parallel to the charge receptor and extending away from the charge receptor in a range from 0 to about 30 degrees from a line extending through the first and second edges.

11. The apparatus according to claim 10, wherein the side wings are about 2 to 5 mm long.

12. The apparatus according to claim 10, wherein the surface of the charge receptor and the portion of the grid are both curved so as to be spaced parallel to the curved portion of the grid.

13. The apparatus according to claim 10, wherein the grid and the side wings are composed of a same material.

14. A xerographic device comprising the apparatus of claim 10.

15. A method of providing a charge uniformity to a surface of a charge receptor, the method comprising: forming a grid including a curved portion, a first side wing extending from a first edge of the curved portion and a second side wing extending from a second edge of the curved portion; angling the side wings at an angle in a range of 0 to about 30 degrees relative to a line extending through the first and second edges of the curved portion of the grid such that the first side wing and the second side wing extend away from the surface of the charge receptor; disposing the grid between at least a first pin array and the charge receptor, the curved portion of the grid spaced parallel to the charge receptor; and applying a voltage to the at least first pin array to generate a charge on the charge receptor; whereby the grid and side wings operate to reduce leakage of corona current to the charge receptor.

16. The method of claim 15, further comprising selectively discharging the surface of the charge receptor in a xerographic device.

* * * * *